US006164441A

United States Patent [19]

Guy et al.

[11] Patent Number: 6,164,441

[45] Date of Patent: Dec. 26, 2000

[54] SKIN CLEANSING DEVICE WITH RE-SEALABLE CONTAINER

[75] Inventors: Michael G. Guy, Fredonia; Dale R. Hamann, Cedarburg; Michael T. Kryshak, Mequon; Julie E. Suhr, Cedarburg, all of Wis.

[73] Assignee: Guy & O'Neill, Inc., Fredonia, Wis.

[21] Appl. No.: 09/133,179

[22] Filed: Aug. 12, 1998

[51] Int. Cl.[7] ..... B65D 33/18; B65D 33/24

[52] U.S. Cl. ..... 206/210; 206/233; 206/494

[58] Field of Search ..... 206/210, 494, 206/37, 38, 233, 438, 440, 209

[56] References Cited

U.S. PATENT DOCUMENTS

| | | | |
|---|---|---|---|
| 4,420,080 | 12/1983 | Nakamura | 206/449 |
| 4,610,357 | 9/1986 | Nakamura | 206/449 |
| 4,651,874 | 3/1987 | Nakamura | 206/205 |
| 4,739,879 | 4/1988 | Nakamura | 206/205 |
| 4,847,071 | 7/1989 | Bissett et al. | 424/59 |
| 4,848,575 | 7/1989 | Nakamura et al. | 206/449 |
| 4,902,283 | 2/1990 | Rojko et al. | 604/290 |
| 4,948,585 | 8/1990 | Schlein | 424/404 |
| 4,959,881 | 10/1990 | Murray | 15/227 |
| 4,964,188 | 10/1990 | Olson | 15/227 |
| 5,019,058 | 5/1991 | Storandt | 604/290 |
| 5,050,737 | 9/1991 | Joslyn et al. | 206/494 |
| 5,152,989 | 10/1992 | Kemp | 424/195.1 |
| 5,229,963 | 7/1993 | Ohtsuka et al. | 365/185 |
| 5,256,417 | 10/1993 | Koltisko | 424/402 |
| 5,411,493 | 5/1995 | Rodriguez | 604/290 |
| 5,500,254 | 3/1996 | Quincy, III et al. | 427/387 |
| 5,525,415 | 6/1996 | Quincy, III et al. | 428/266 |
| 5,605,749 | 2/1997 | Pike et al. | 442/60 |
| 5,687,775 | 11/1997 | Thompson et al. | 139/426 |
| 5,702,992 | 12/1997 | Martin et al. | 442/123 |
| 5,720,736 | 2/1998 | Hatsuda et al. | 604/368 |
| 5,725,311 | 3/1998 | Ponsi et al. | 383/66 |

*Primary Examiner*—Jacob K. Ackun
*Attorney, Agent, or Firm*—Michael Best & Friedrich LLP

[57] ABSTRACT

A device for cleansing skin having a container made from a flexible polymeric sheet with an opening in its top, a self-resealing flap positioned on the container top, a stack of non-woven cleansing cloths placed within the container, and an insulator positioned under the stack of cleansing cloths. The flap is constructed from a laminated polyolefin composite, exhibits memory, and reseals itself against the container after being opened. The insulator is sized and shaped so that it may be easily handled with automated machinery, but is designed to enhance the heat retention capabilities of the device. The cloths in the stack of cloths are folded in a manner that facilitates their removal from the container and are impregnated with a cleansing solution that is pH balanced and exhibits a low incidence of allergic reactions.

23 Claims, 3 Drawing Sheets

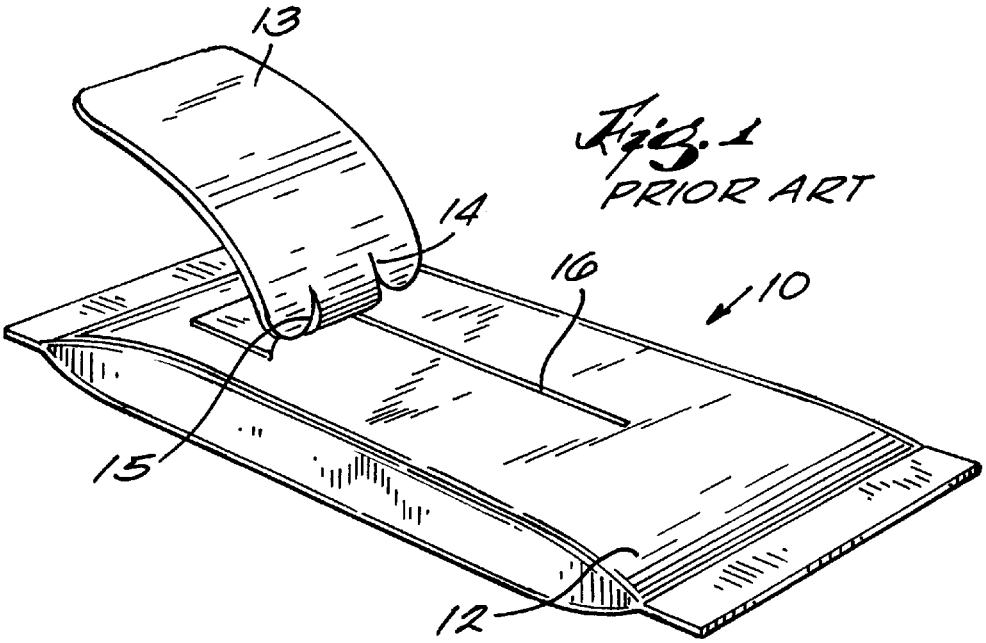
Fig. 1
PRIOR ART
Fig. 2.
PRIOR ART
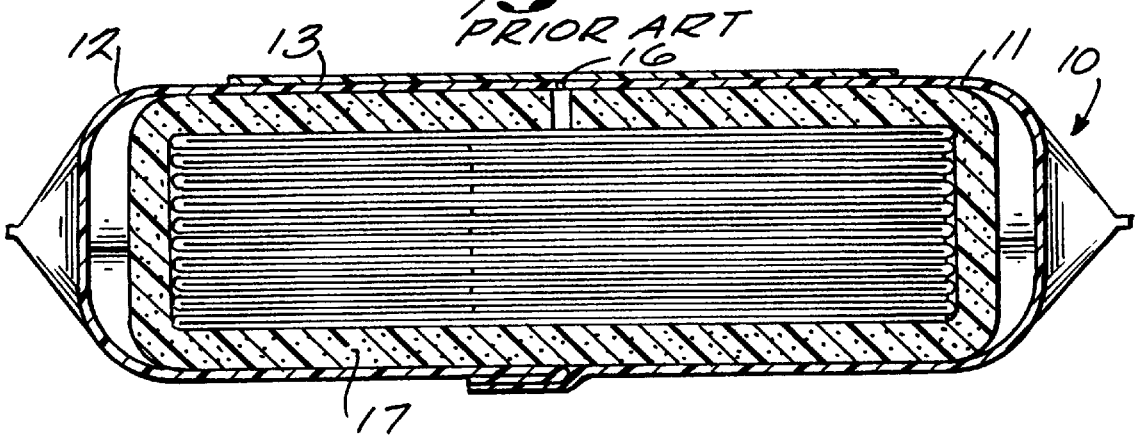

20
43
40
30
6
42
31
24
45
44
22
6
33
60
28

34
50
50
34
44
42
33
77
77
77
46
24

6A
20
24
75
77
100
26

40
60
50
42
46
54
52

30
77
34
31
56
24
33
22
28

SKIN CLEANSING DEVICE WITH RE-SEALABLE CONTAINER

FIELD OF THE INVENTION

The present invention relates generally to devices that are used to cleanse the skin. More particularly, the present invention relates to a device for cleansing skin with a re-sealable container.

BACKGROUND

In many environments and circumstances it is impossible or impractical to clean the skin in a traditional manner such as by showering. For example, it is often impossible for patients in a hospital to shower, and in other circumstances, such as while camping, running water is not available. Alternative types of bathing, including what are known as "sponge baths," are often used in these circumstances. In hospitals, sponge baths are administered to patients in order to maintain hygiene. Typically, a traditional sponge bath requires the use of a sponge or wash cloth, soap, water, and a tub or basin to hold water. The bath involves soap application with the cloth, a rinse with water, and toweling for drying the skin surface.

This type of bathing can be quite time consuming and actually decrease body cleanliness due to bacterial contamination. Contamination occurs from using the same water to bathe multiple areas of the body. Further, because temperatures of the bathing materials (soaps, wash cloths, and basins) are unregulated, conditions for bacterial growth can actually be enhanced with such bathing techniques.

Another difficulty with sponge baths is that the bathing materials (tub, soap, cloth, and towels) are difficult to transport and bathing cannot occur without clean water. Having a compact, easy-to-transport, non-water dependent cleansing device is a necessity when traveling and is even more important when engaging in activities such as camping.

There have been some attempts to address some of the problems noted above and a number of skin cleansing devices and systems have been developed. One type of non-water dependent, skin cleansing device is shown in U.S. Pat. No. 5,702,992 (the '992 patent"). The device disclosed in the '902 patent includes a plurality of cleanser-impregnated cloths made of cotton and cellulose acetate. Although the device does not require water and is compact, the cloths come in a sealed package, and the package is a one-time use device in which the cloths are used and disposed of after use. A drawback of this type of package or container is that it is not re-sealable. Thus, if only a portion of the cloths in the container are needed for bathing, the remaining cloths cannot be properly re-sealed for a subsequent use.

There are, however, some skin cleansing devices with re-sealable containers. One such device is available from Sage Products, Inc. under the brand name Comfort Bath™ and is shown labeled with the numeral 10 in FIGS. 1 and 2. The device 10 has a stack of cloths 11 and a package 12 with a re-sealable flap 13 with two c-shaped cuts 14 and 15. The package 12 is designed to be heated in a microwave oven before use to help ensure a warm application to the skin. However, the device 10 suffers from several limitations. First, its package 12 provides only a narrow slit 16 to access the cloths within it. Pulling the cloths 11 through the slit 16 and out from under the wrap-around insulator is difficult and usually requires extensive handling of the package with the users hands, which can cause contamination. Second, additional contamination can occur after the package is opened because its re-sealable flap 13 remains open. Third, the device 10 has an expensive, wrap-around insulator 17 (FIGS. 2 and 3) which acts to prevent heat loss from the stack of cloths 11 after heating. This type of insulator, while effective for preventing heat loss, is difficult to handle and relatively large. It increases material, production, packaging, and disposal costs.

Accordingly, there is a need for an inexpensive skin cleansing device that is designed to reduce contamination of the cleansing cloths within it. Additionally, it would be desirable to have a device that has heat-retaining properties without the need for expensive and hard to handle insulators.

OBJECTS AND SUMMARY OF THE INVENTION

Therefore, it is an object of the present invention to provide a skin cleansing device that reduces bacterial contamination of the package and cleansing cloths by providing a self-resealing flap.

It is an additional object of the present invention to provide a skin cleansing device that retains the heat in the cleansing cloths or articles with an insulator that is inexpensive and readily positioned adjacent to the cleansing cloths and positioned in packaging for the cloths.

These and other objectives are achieved in a device for cleansing skin that includes a container with an opening in its top, a re-sealable flap positioned on the container top, a stack of non-woven fabric cleansing articles placed within the container, and an insulator positioned under the stack of articles.

The container is constructed from a polymeric material and is formed in a substantially rectangular shape so that it has a fin seal and two end seals. The opening in the container has an oval shape in order to facilitate access to the cleansing articles in the container.

The re-sealable flap has a tongue that is dimensioned to fit within the opening in the top of the container. The tongue is adhesive-free so as to prevent contamination of the cleansing articles with adhesive. The edges of the flap extend beyond the tongue and are coated with an adhesive on their downwardly facing surfaces. When the flap is closed, these edges create a tight seal with the top surface of the container. The flap is constructed using over-lamination so that it closes itself against the top of the container, whereas prior-art flaps have a tendency roll or curl up on themselves and hinder closing. Some prior art devices (such as the device 10) suffer from an additional drawback in that the cuts used in the flaps hinder re-sealability of the flap after being initially opened.

The cleansing cloths or articles in the device are made from a non-woven fabric impregnated with a cleansing solution. The fabric of the articles may be of a latex-free, binderless, needle-punched blend of 50% rayon and 50% polyester. This composition does not chemically react with the cleansing solution and, thus, aids in maintaining its efficacy. Further, the fabric holds the solutions in its fibers thereby minimizing migration of the solution from the cleansing articles into the packaging or each other.

The cleansing solution impregnated in the cleansing articles contains purified water, propylene glycol, glycerin, cocoamphodiacetate, boric acid, 2-phenoxyethanol, diazolidinyl urea, polysorbate 20, P-hydroxybenzoate esters, vitamin E, aloe vera, simethicone, and fragrance and provides several distinctive advantages over existing solutions. First, the solution does not contain nonoxynol 9, which can cause an allergic reaction with particular individuals. Second, the cleansing solution, after application to the skin surface, leaves no residue or stickiness and dries quickly without toweling.

The device also includes an insulator within the container. The insulator may be comprised of polyurethane, polyethylene, polystyrene, or similar materials, but is preferably made from polyethylene. The insulator is sized and shaped so that it covers no more than 60% of the surface area of the stack of non-woven fabric articles, and specifically so that it does not wrap around the top of the stack of cleansing articles. This design enables the insulator to be inserted under the stack of cleansing articles using automated manufacturing equipment whereas prior-art insulators must be positioned around the stack of cleansing articles. Thus, significant cost savings are achieved with the present invention. Additionally, the size and placement of the insulator pad facilitates heat retention within the package of cleansing articles.

These and other features, aspects, and advantages of the present invention will become apparent and be better understood by reference to the detailed description of the invention taken in combination with the accompanying drawings.

BRIEF DESCRIPTION OF THE DRAWINGS

FIG. 1 is a perspective view of a known skin cleansing device;

FIG. 2 is a cross-sectional view or the skin cleansing device of FIG. 1, shown with the flap closed;

DETAILED DESCRIPTION OF THE PREFERRED EMBODIMENTS

Figure 5:
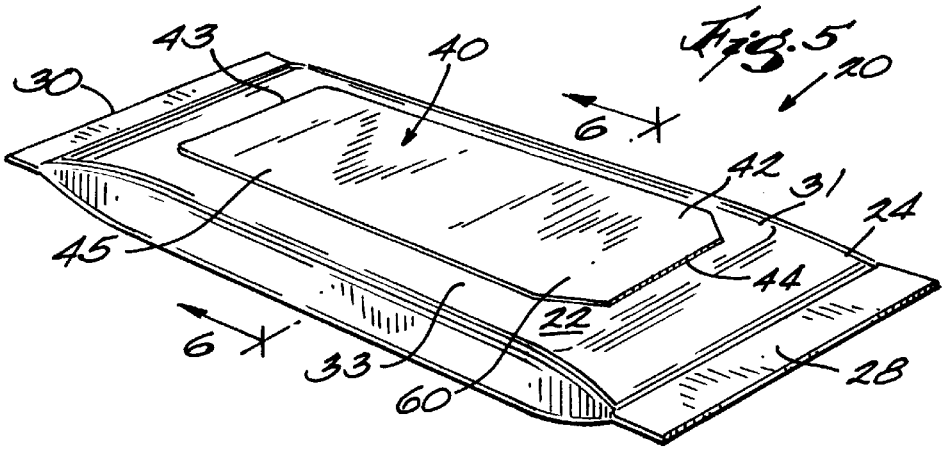
FIG. 5 is a perspective view of the skin cleansing device of the present invention.
Figure 6A:
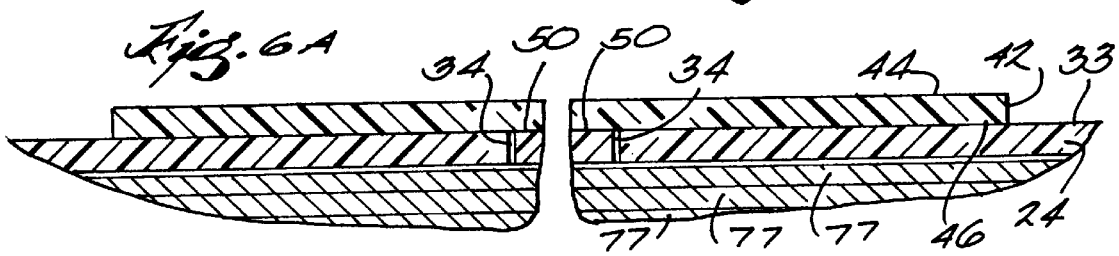
FIG. 6A is an enlarged, partial view of the skin cleansing device as shown in FIG. 6.
Figure 6:
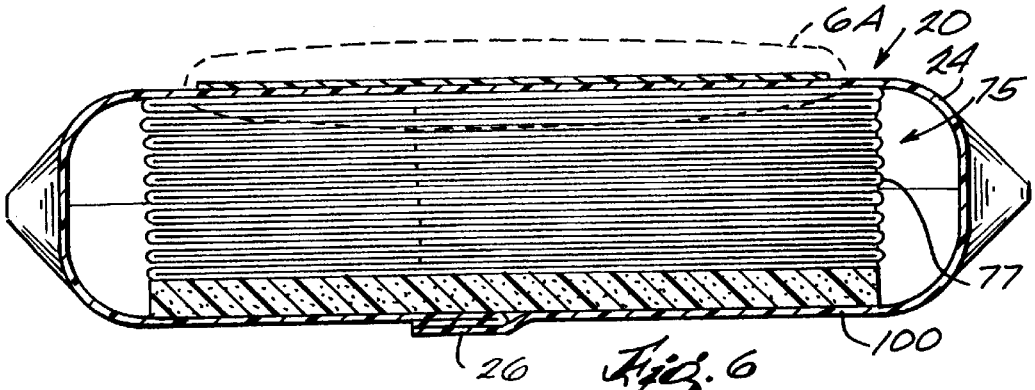
FIG. 6 is a cross-sectional view of the skin cleansing device of the present invention taken generally along the line 6—6 in FIG. 5.

A skin cleansing device 20 is shown in FIG. 5. The skin cleansing device 20 includes a container 22 in the form of a wrapper or bag 24 formed from a sheet of man-made, polymeric material. The bag 24 is folded so that it has a fin seal 26 (FIG. 6) and two end seals 28 and 30.

Figure 7:
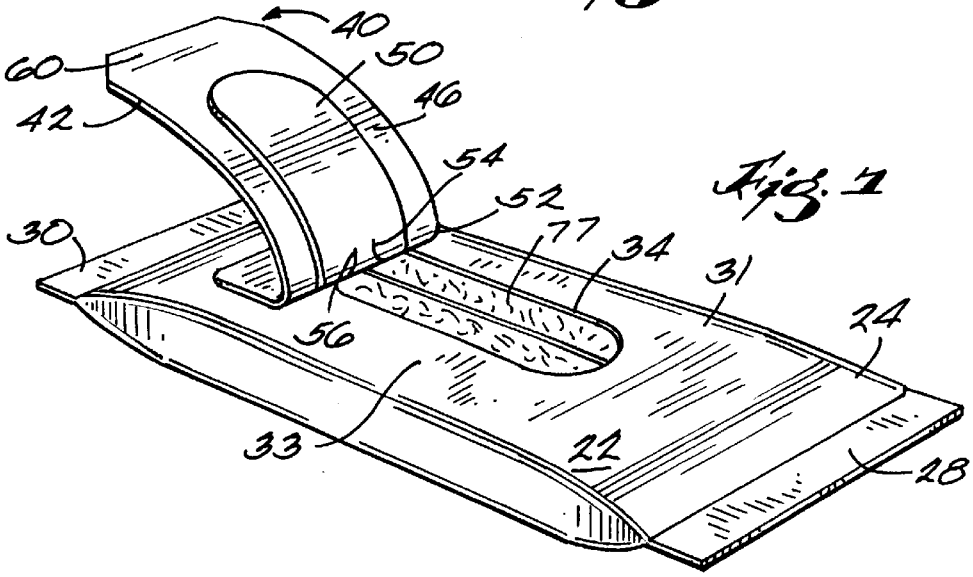
FIG. 7 is a perspective view of the skin cleansing device of the present invention, showing a re-sealable flap suspended before rolling back over the container top opening.

The container 22 has a top 31 with an exposed surface 33. The top 31 has an oval shaped opening 34 (FIGS. 6A and 7) which has a relatively wide width, approximately 1½", to provide easy access to cleansing articles or cloths (discussed below) in the bag 24. A re-sealable flap 40 is adhered to the exposed surface 33 of the top 31. The re-sealable flap 40 includes a label 42 preferably made from a laminated, polyolefin composite. The label 42 has a first end 43, a second end 44, an outwardly facing surface 45 and an inwardly facing surface 46. The inwardly facing surface 46 is coated with an adhesive such as a semi-permanent acrylic having a thickness of approximately 0.0017" and is commercially available from Prime Label & Screen, Inc., Pewaukee, Wis. Labels suitable for use in the present invention are also available from Prime Label & Screen, Inc. under the designation Prime #1158. The laminated construction of the label 42 causes it to exhibit memory. That is, it tends to reseal itself after being opened.

Adhered to a center portion of the inwardly facing surface 46 is a tongue 50 cut out of the bag 24. The tongue 50 is sized and shaped to match the dimensions of the opening 34 and fit snugly therein. The tongue 50 is cut out so that a portion of it remains integral with the bag 24. In particular, the tongue 50 has a hinge 52. Two arced cuts 54 and 56 are made in the tongue 50 to improve performance and specifically to help prevent tearing of the tongue 50 from the bag 24.

The label 42 has an adhesive-free tab 60 that extends from the second end 44 opposite the hinge 52. The tab 60 facilitates easy opening of the flap 40.

Located within the bag 24 is a plurality or stack 75 of cleansing articles or cloths 77. Each cloth 77 is designed to be impregnated or soaked with a cleansing solution (discussed below). It has been found that the greatest compatibility with the cleansing solution and adhesives used in the device 20 is achieved when the cloths 77 are made from a non-woven, latex-free, binderless, needle-punched fabric of 50% Rayon fibers and 50% Polyester fibers. The cloths 77 are latex-free to avoid potential allergic reactions. Furthermore, the best bathing results are achieved if the fabric has the properties listed in Table 1 below.

TABLE 1

| | |
|---|---|
| Weight | 4.5 oz./yd.$^2$ ± .5 oz |
| Thickness | 0.092 in. ± .010 in. |
| Tensil Strength | |
| Warp | 20 lbs. min |
| Fill | 40 lbs. min |

Figure 4:
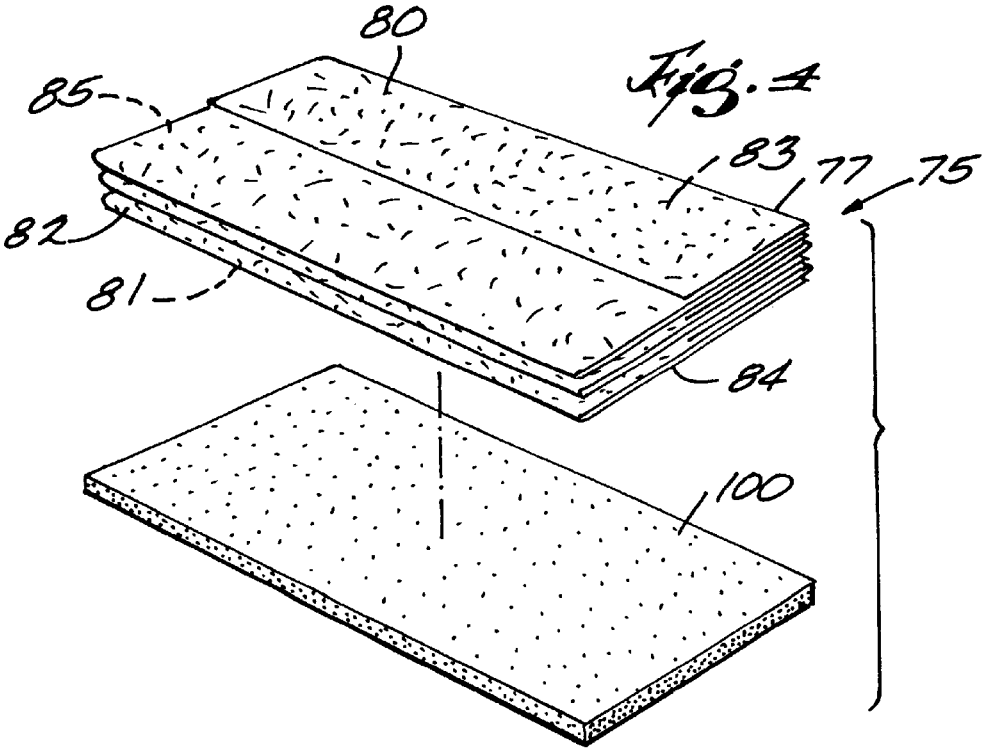
FIG. 4 is an exploded view of the stack of cleansing articles and insulator for a skin cleansing device made in accordance with the present invention.

The cloths 77 may be removed from the bag 24, one at a time, and used to cleanse the skin of a person or other animal using techniques known in the art. To facilitate their removal the clothes are folded in a Z-shaped fold, as best seen by reference to FIG. 4.

One key element in effective cleaning is the solution impregnated in the cleansing cloths 77. Preferably, the cleansing solution is formulated according to the information in Table 2.

TABLE 2

| Ingredient | % w/w | |
|---|---|---|
| 1. Purified Water (UV Sterilized) | 92.765 | (approx.) |
| 2. Propylene Glycol | 3.000 | |
| 3. Glycerin U.S.P. | 2.500 | |
| 4. Miranol C2M Conc NP (Cocoamphodiacetate) | 0.500 | |
| 5. Phenonip (P-Hydroxybenzoate Esters, 2-Phenoxyethanol) | 0.400 | |
| 6. Boric Acid | 0.400 | (approx.) |
| 7. Germall II (Diazolidinyl Urea) | 0.250 | |
| 8. Polysorbate 20 | 0.150 | |
| 9. Vitamin E | 0.010 | |
| 10 Aloe Vera 1X | 0.010 | |
| 11. Simethicone Emulsion U.S.P | 0.010 | |
| 12. Fragrance | 0.0005 | |
| | 100.00 | |

The cleansing solution is formulated by blending Germall II with purified water until the Germall II dissolves. In a separate vessel, Phenonip and Propylene Glycol are blended and then Glycerin and MiranolC2M Conc NP and added to the Phenonip and Glycol blend. In a third vessel, Polysorbate 20 and Vitamin E are combined and the fragrance is added to this combination. The Phenonip mixture and fragranced Polysorbate 20 mixture are then added to the Germall II solution. Aloe Vera 1X and Simethicone and then added to the Germall II solution. Finally, Boric acid is used to adjust the pH of the mixture to approximately 5.50 to 6.50. The cleansing solution is then impregnated in the cloths 77 using methods known in the art.

The cleansing solution provides excellent cleaning without leaving any stickiness or residue on the skin surface and provides effective cleaning without the use of known allergens such as nonoxynol 9. Additionally, the cleansing solution is buffered to the normal pH of human skin.

As already indicated, the bag 24 contains a number of cloths 77. As best seen by reference to FIG. 4, the stack 75 of cloths 77 has a top 80, a bottom 81, first and second long sides 82 and 83, and first and second short sides 84 and 85. The stack 75 has a surface area equal to the sum of the areas of the top 80, bottom 81, first and second long sides 82 and 83, and first and second short sides 84 and 85. Typically, the surface area of the stack is about 88 in.$^2$ Positioned underneath the stack 75, directly adjacent the bottom 81 is an insulator 100. The insulator 100 is preferably sized and shaped so that it matches the length and width dimensions of one cloth 77 and covers the entire, but no more than the entire bottom 77. More particularly, the insulator 100 is sized and shaped so that it covers no more than 60% of the surface area of the stack 75 and so that it does not wrap around the stack's sides and top, as with prior-art insulators. It is particularly important that the insulator 100 is not wrapped around the top 80 as such a design interferes with the retrieval of cloths from their packaging. However, the insulator 100 could be designed to cover all or part of the long sides 82 and 83.

The insulator 100 is designed to prevent heat loss from the bag 24 and cloths 77 after they have been heated, for example, in a microwave oven. In particular, the insulator 100 is designed to prevent heat transfer through the bottom 81 of the stack 75 when the heated device 20 is removed from a heated or warm environment.

The inventors have determined that the bulk of heat loss in the cloths 77 in the stack 75 occurs through heat transfer through the bottom 81 when the device 20 is placed on a relatively cold surface (not shown) after heating. Moreover, as can be seen by reference to Table 3, below, using the insulator 100 to cover only the bottom 81, acceptable heat retention as compared to a full wrap-around insulator is achieved, but adds less cost to the device 20 because the insulator 100 may be handled more efficiently with automated packaging machinery. Furthermore, since the insulator 100 is made from less material than prior-art insulators, less waste is generated, which for end users such as hospitals translates into significant disposal cost reductions.

TABLE 3

| Set 1 (No Foam) | | | Set 2 (Bottom Foam) | | | Set 3 (Full Foam) | | |
|---|---|---|---|---|---|---|---|---|
| Time | (Min) | Temp (° F.) | Time | (Min) | Temp (° F.) | Time | (Min) | Temp (° F.) |
| | | | Test A | | | | | |
| | 1 | 116 | | 1 | 100 | | 1 | 110 |
| | 2 | 122 | | 2 | 126 | | 2 | 122 |
| | 3 | 122 | | 3 | 126 | | 3 | 123 |
| | 5 | 115 | | 5 | 123 | | 5 | 123 |
| | 8 | 112 | | 8 | 120 | | 8 | 121 |
| | 10 | 98 | | 10 | 118 | | 10 | 119 |

TABLE 3-continued

| Set 1 (No Foam) | | | Set 2 (Bottom Foam) | | | Set 3 (Full Foam) | | |
|---|---|---|---|---|---|---|---|---|
| Time | (Min) | Temp (° F.) | Time | (Min) | Temp (° F.) | Time | (Min) | Temp (° F.) |
| | 15 | 95 | | 15 | 112 | | 15 | 114 |
| | 20 | 94 | | 20 | 108 | | 20 | 110 |
| | 25 | 92 | | 25 | 104 | | 25 | 106 |
| | 30 | 96 | | 30 | 100 | | 30 | 103 |
| (1 hr) | 60 | 80 | (1 hr) | 60 | 86 | (1 hr) | 60 | 93 |
| (2 hr) | 120 | 80 | (2 hr) | 120 | 77 | (2 hr) | 120 | 82 |
| | | | Test B (first cloth removed at second minute) | | | | | |
| | 1 | 120 | | 1 | 127 | | 1 | 120 |
| | 2 | 117 | | 2 | 130 | | 2 | 125 |
| | 3 | 114 | | 3 | 124 | | 3 | 124 |
| | 4 | 106 | | 4 | 122 | | 4 | 122 |
| | 5 | 98 | | 5 | 118 | | 5 | 119 |
| | 6 | 96 | | 6 | 115 | | 6 | 115 |
| | 7 | 94 | | 7 | 112 | | 7 | 115 |
| | 8 | 92 | | 8 | 105 | | 8 | 105 |
| | 10 | 88 | | 10 | 99 | | 10 | 100 |
| | 15 | 86 | | 15 | 93 | | 15 | 94 |

Figure 3:
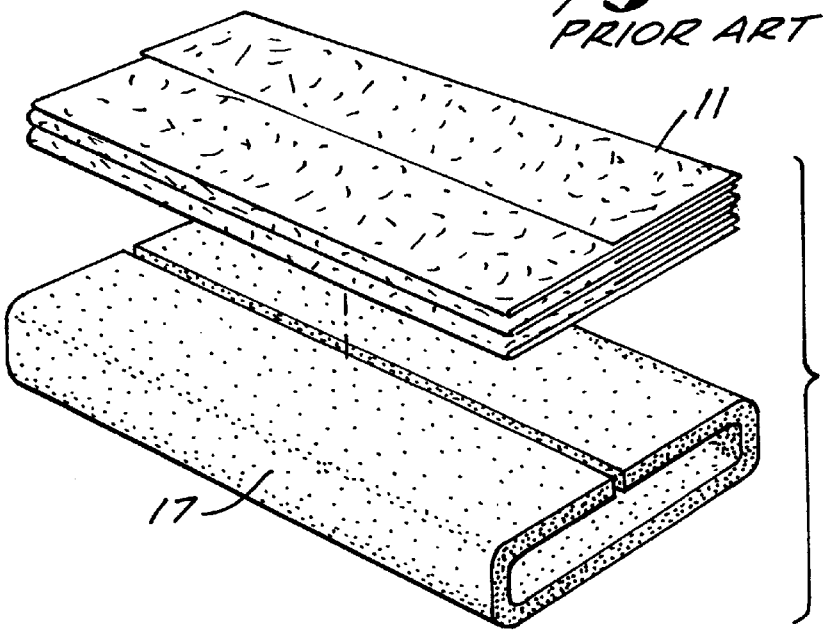
Fig. 3 PRIOR ART
FIG. 3 is an exploded view of the skin cleansing device of FIG. 1 shown with the packaging material removed from the stack of cleansing articles.

The data in Table 3 represents a test on three sample sets. Set 1 represents a package of cleansing cloths having no insulator. Set 2 represents a package of cleansing cloths having an insulator covering only the bottom of the stack of cloths; that is, an insulator identical to insulator 100. Set 3 represents a package of cloths having a 10"×8" foam piece wrapped around the stack of cloths; similar to the insulator shown in FIGS. 2 and 3. Each package of cloths was heated using a microwave to a temperature of approximately 120° to 130° F. and removed from the heated microwave and allowed to cool for a period of time. Test A was a static temperature study conducted by heating the packages and placing thermometers under the labels for Sets 1 and 2, and placing a thermometer under the wrap-around folds of the insulator and label for Set 3. The labels for each Set were secured around their respective thermometer and monitored for temperature loss over a two hour period. Test B was a functional use study, where after each package was heated, individual cloths were removed in one minute intervals except for the last or, in the experiment's case, eighth cloth. Temperature readings were taken after each cloth's removal and the label resealed around the thermometer. Temperature readings were made from eight minutes to a final check at fifteen minutes.

Several observations were made from the testing. The heating time for all sets was approximately one minute (60 seconds). However, the results from Test A indicate only nominal heat retention differences between Set 2 and Set 3 with a continuously scaled package. The greatest disparity of temperature occurred between the Set 3 and Set 1 packages at the 15 minute mark, amounting to a difference of 19 degrees. In other intervals, the temperature difference was even less significant with all Sets reaching near ambient temperature in two hours.

The results of Test B, employing more functional use conditions, showed more heat retention benefit for the Set 2 and Set 3 packages than for the Set 1 package. The Set 2 and Set 3 packages showed an impressive temperature average of 118° F. from one minute to eight minutes. The Set 1 package had an average of 105° F.

The first eight to ten minutes of normal use after heating are considered "critical field use" time, and while the consistently high temperature levels after cloth extractions and resealings of the Set 3 package is excellent, the heat retention of the Set 2 package is also excellent, but provides the greatest cost value. From the testing, it was found that the best heat retention performance in the device 20 is achieved when the insulator 100 has the characteristics set forth in Table 4.

TABLE 4

| Test Name | Units | 3/16" Polyethylene Foam |
|---|---|---|
| Thermal Conductivity | BTU-IN/HR-SQ FT | 0.275" |
| Density | PCF (LBS./CU. FT) | 1.58 |
| Cell Size | Cells/Inch | 16–18 |
| Compressive Strength | PSI @ 25% Deflection | 5.31 |
| Buoyancy | PCF (LBS./CU. FT) | 56 |
| Tensile Strength Mach Dir | PSI | 49.0 |
| Cross Mach Dir | PSI | 26.5 |
| Tear Strength Mach Dir | LBS FOR CE/INCH | 12.9 |
| Cross Mach Dir | LBS FOR CE/INCH | 9.4 |
| Elongation Mach Dir | Percent | 90.6 |
| Cross Mach Dir | Percent | 65.2 |

Thus, as can be seen from the discussion above, the present invention provides an improved cleansing device which has a superior re-sealing mechanism to prevent contamination, superior heat retention capabilities, and excellent cleaning characteristics with a gentle, pH balanced solution exhibiting a low incidence of allergic reactions. Furthermore, the heat retention characteristics were achieved at a relatively low cost. However, although these improvements are believed to be most readily achieved in the embodiments shown and described herein, it is to be understood that the invention is not intended to be limited to the specific embodiments set forth above. Therefore, the present invention may be embodied in other forms without departing from the spirit or scope of this invention, all of which are intended to be encompassed by the appended claims.

What is claimed is:

1. A device for cleansing skin, the device comprising a container, the container having a top and an opening in its top;

a re-sealable flap constructed to exhibit memory, the flap positioned on the top of the container and dimensioned to cover the opening;

a stack of non-woven fabric cloths positioned within the container; the stack having a surface area; and an insulator within the container, the insulator sized and shaped so that it covers 60% or less of the surface area of the stack of non-woven fabric cloths.

2. A device as in claim 1 wherein the insulator is made from polyethlene and has a thermal conductivity of about 0.275.

3. A device as in claim 2, wherein the insulator has a thickness of about 3⁄16".

4. A device as in claim 1 wherein the stack of cloths has a top, a bottom, and plurality of sides, and the insulator is sized and shaped so as to cover no more than the bottom of the stack.

5. A device as in claim 1 wherein the cloths in the stack of cloths are impregnated with a cleansing solution and the cleansing solution includes purified water, propylene glycol, glycerin, cocoamphodiacetate, boric acid, 2-phenoxyethanol, diazolidinyl urea, polysorbate 20, P-hydroxybenzoate esters, vitamin E, aloe vera, simethicone, and fragrance.

6. A device as in claim 5, wherein the cloths are made from a blend of rayon and polyester fibers.

7. A device as in claim 6, wherein the cloths have a warp tensile strength of about 20 pounds and a fill tensile strength of about 40 pounds.

8. A device as in claim 1, wherein the cloths are z-folded cloths.

9. A device for cleansing skin, the device comprising:

a container made from a sheet of polymeric material, the container having a top and an opening in its top;

a self-resealing flap, the flap having a tongue, the tongue including a hinge connected to the container and being dimensioned to cover the opening, the flap further including a label with a first surface and a second surface, the second surface coated with an adhesive and adhered to the flap;

a stack of non-woven fabric cloths positioned within the container; the stack having a surface area and a bottom, each cloth impregnated with a cleansing solution; and an insulator within the container, the insulator sized and shaped so as to cover no more than the bottom of the stack of non-woven fabric cloths.

10. A device as in claim 9, wherein the tongue has two cuts near the hinge.

11. A device as in claim 9, wherein the adhesive is a semi-permanent acrylic.

12. A device as in claim 9, wherein the flap exhibits memory.

13. A device as in claim 9, wherein the container is made from a polymeric material.

14. A device as in claim 9, wherein the sheet of material is folded into a bag having a fin seal and two end seals.

15. A device as in claim 9, wherein the label is made from a laminated polyolefin composite.

16. A device as in claim 15, wherein the label has an adhesive-free tab.

17. A device as in claim 9, wherein the insulator is sized and shaped so that it covers 60% or less of the surface area of the stack.

18. A device as in claim 17, wherein the insulator is made from polyethylene and has a thermal conductivity of about 0.275.

19. A device as in claim 17, wherein the stack of cloths has a top, a bottom, and a plurality of sides, and the insulator is sized and shaped so as to cover no more than the bottom of the stack.

20. A device as in claim 17, wherein the cleansing solution includes purified water, propylene glycol, glycerin, cocoamphodiacetate, boric acid, 2-phenoxyethanol, diazolidinyl urea, polysorbate 20, P-hydroxybenzoate esters, vitamin E, aloe vera, simethicone, and fragrance.

21. A device as in claim 20, wherein the cloths are made from a blend of rayon and polyester fibers.

22. A device for cleansing skin, the device comprising:

a container made from a sheet of polymeric material, the container having a top and an opening at its top;

a self-resealing flap, having a tongue the tongue cut out of the top of the container, dimensioned to cover the opening, and having a hinge, the flap further including a label with a first surface and a second surface, the second surface coated with an adhesive and adhered to the flap;

a stack of non-woven fabric cloths positioned within the container; the stack having a surface area and a bottom and each cloth impregnated with a cleansing solution; and an insulator within the container, the insulator sized and shaped so as to cover no more than the bottom of the stack.

23. A device as in claim 22, wherein the cloths are z-folded cloths.

* * * * *